United States Patent [19]

Vaughn

[11] Patent Number: 4,638,611

[45] Date of Patent: Jan. 27, 1987

[54] GUY-WIRE GUARD ASSEMBLY AND FASTENING SYSTEMS THEREFOR

[76] Inventor: Charles R. Vaughn, P.O. Box 33417, San Diego, Calif. 92103

[21] Appl. No.: 816,553

[22] Filed: Jan. 6, 1986

[51] Int. Cl.[4] ..... E04H 12/20

[52] U.S. Cl. ..... 52/147; 174/136

[58] Field of Search ..... 52/147; 174/136, 5 R

[56] References Cited

U.S. PATENT DOCUMENTS

| | | | |
|---|---|---|---|
| Re. 19,639 | 4/1935 | Miller | 189/31.5 |
| 1,485,994 | 3/1924 | Salisbury . | |
| 1,630,356 | 5/1927 | Perks . | |
| 1,645,748 | 10/1927 | Gammeter . | |
| 1,765,823 | 6/1930 | Burke . | |
| 1,811,369 | 6/1931 | St. John | 52/147 |
| 1,933,818 | 11/1933 | Miller | 189/31.5 |
| 1,995,503 | 3/1935 | Elliott | 52/147 |
| 1,996,871 | 4/1935 | Lemont | 52/147 |
| 2,880,828 | 4/1959 | Skubal | 189/31.5 |
| 3,057,443 | 10/1962 | Schlein | 52/147 |
| 3,173,519 | 3/1965 | Sullivan | 189/31.5 |
| 3,251,161 | 5/1966 | Stirn | 52/147 |
| 3,295,875 | 1/1967 | Fisher | 52/147 X |
| 3,425,456 | 2/1969 | Schibig | 138/162 |
| 3,428,742 | 2/1969 | Smith | 52/147 X |
| 3,900,697 | 8/1975 | Yotsugi | 174/5 R |
| 3,926,141 | 12/1975 | Taylar | 52/147 X |
| 4,223,491 | 9/1980 | Vaughn | 52/147 |

*Primary Examiner*—Carl D. Friedman

*Attorney, Agent, or Firm*—Owen, Wickersham & Erickson

[57] ABSTRACT

A guard assembly for a guy-wire connected to a ground anchor rod. The assembly includes at least one elongate generally tubular body of weather-and-impact-resistant, generally rigid plastic, having a 180° arcuate portion and at each end thereof a straight extension portion, the extension portions being generally parallel to each other. Preferably, two such bodies are assembled together with the extension portions of one body touching and overlapping those of the other. The overlapping extension portions are diametrically opposite each other, and the two arcuate portions are diametrically opposite each other. This assembly encloses the guy-wire and/or its ground anchor rod, preferably from about ground level to a height well thereabove. Bolts extend diametrically across this assembly to hold it together, preferably from one pair of overlapping portions to the other or across the centers of the arcs. Each bolt preferably has a vandal-resistant nut threaded on it. At least one guard body has at least one circumferentially aligned pair of fastener openings through its arcuate portion and a fastener combination for each pair of fastener openings. A bolt member has a head outside the guard assembly and a shank extending inwardly through one fastener opening to a nut at its inner end. A locking washer member has a flat portion with an oval opening therethrough and its main axis oriented longitudinal of the flat portion. The bolt member passes through the oval opening between its head and its nut, and an end tab of the locking washer member extends approximately perpendicularly from one end of the flat portion to a hooked outer end extending through the other fastener opening and engages the outer wall of the adjacent guard body.

53 Claims, 26 Drawing Figures

FIG. 1
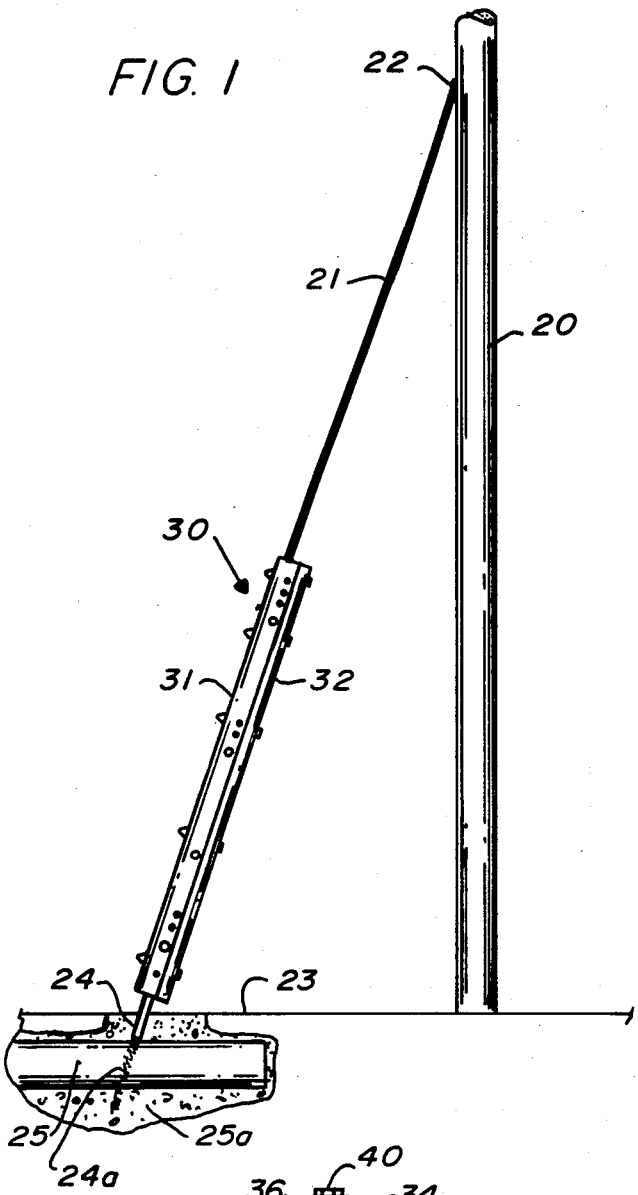
FIG. 2
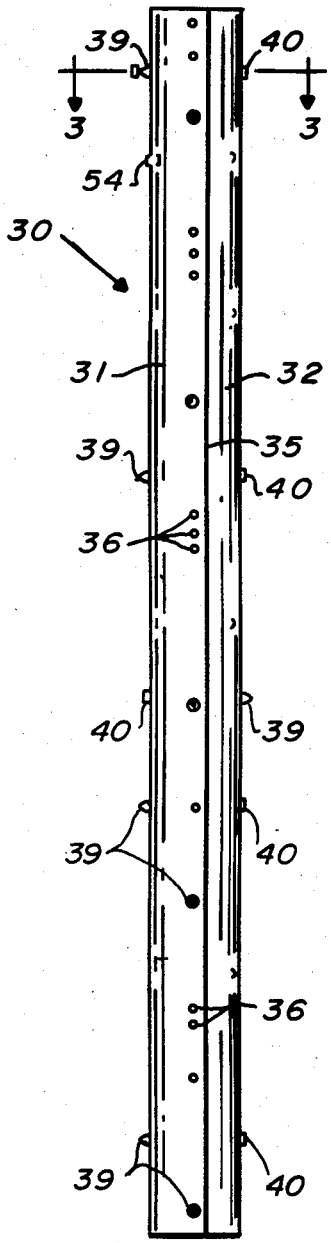
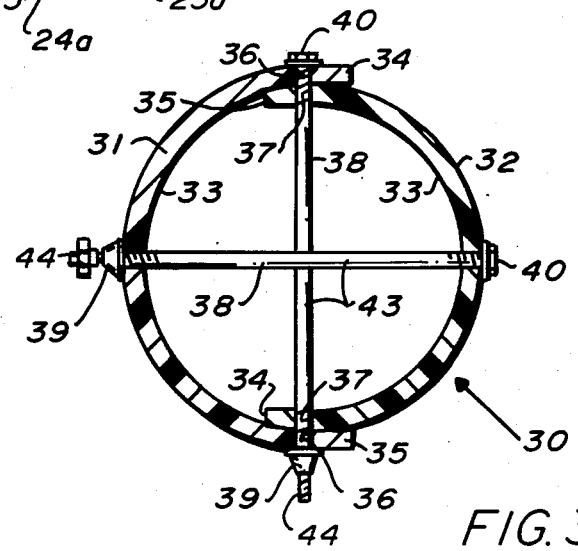
FIG. 3

FIG. 4
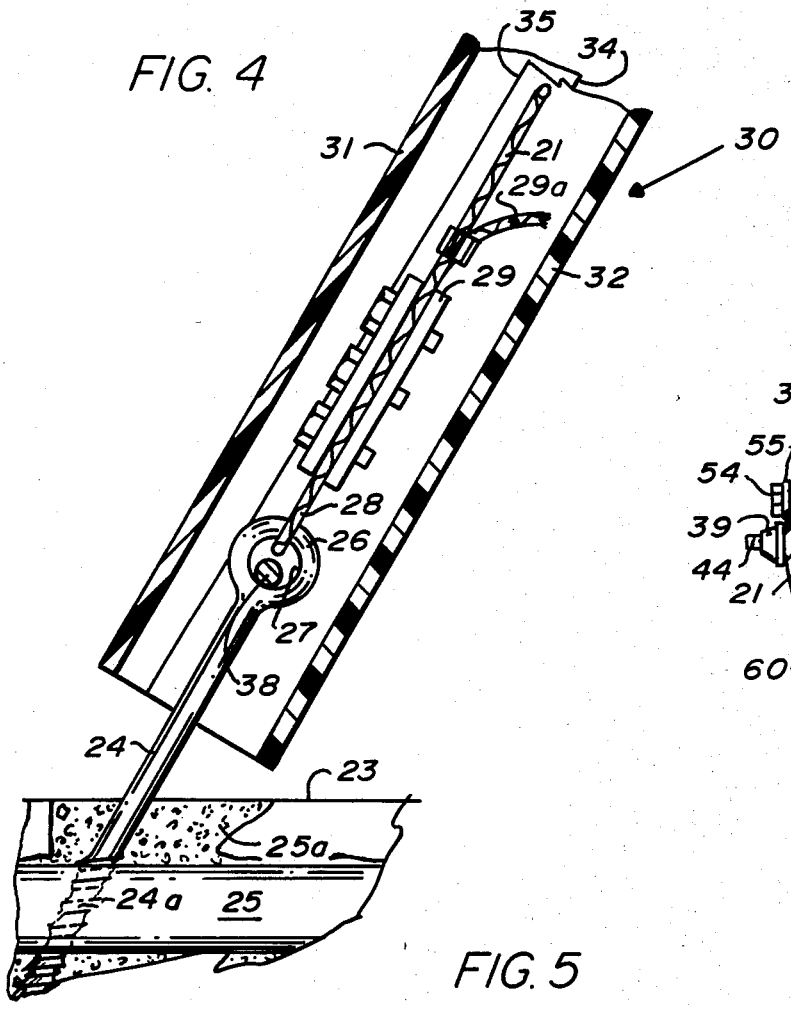
FIG. 6
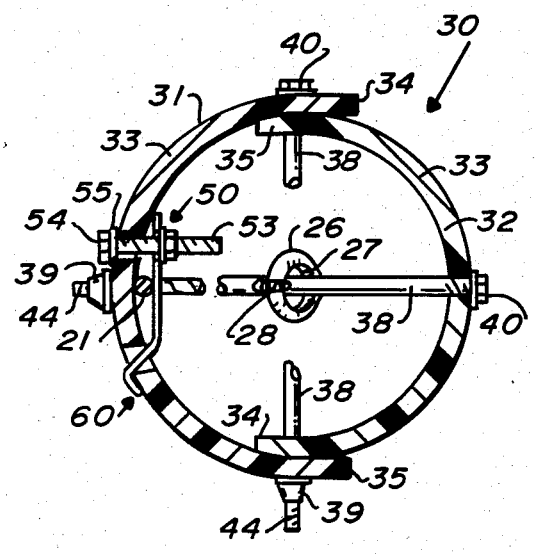
FIG. 5
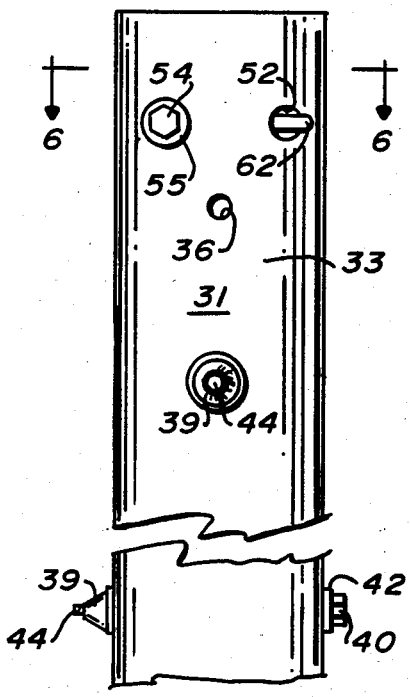
FIG. 7
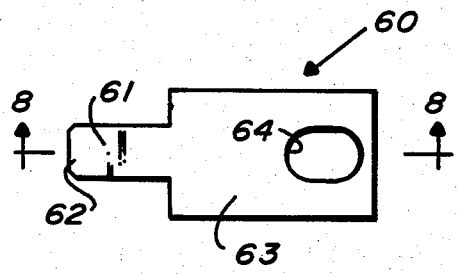
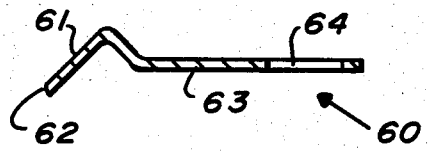
FIG. 8

FIG. 9
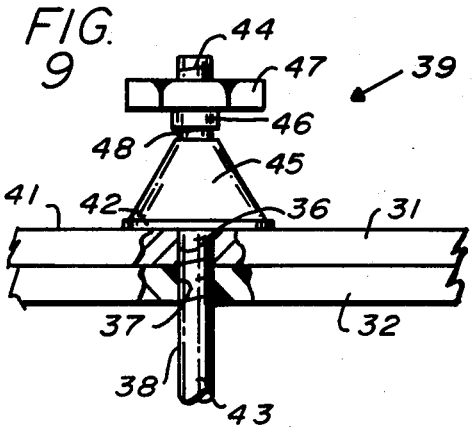
FIG. 10
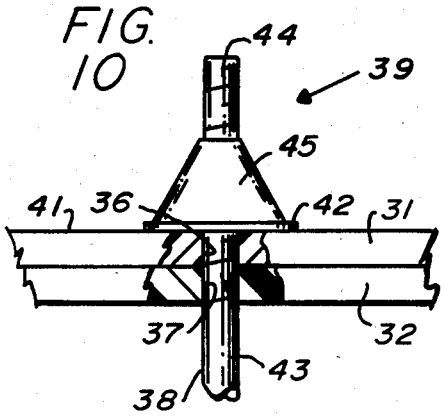
FIG. 15
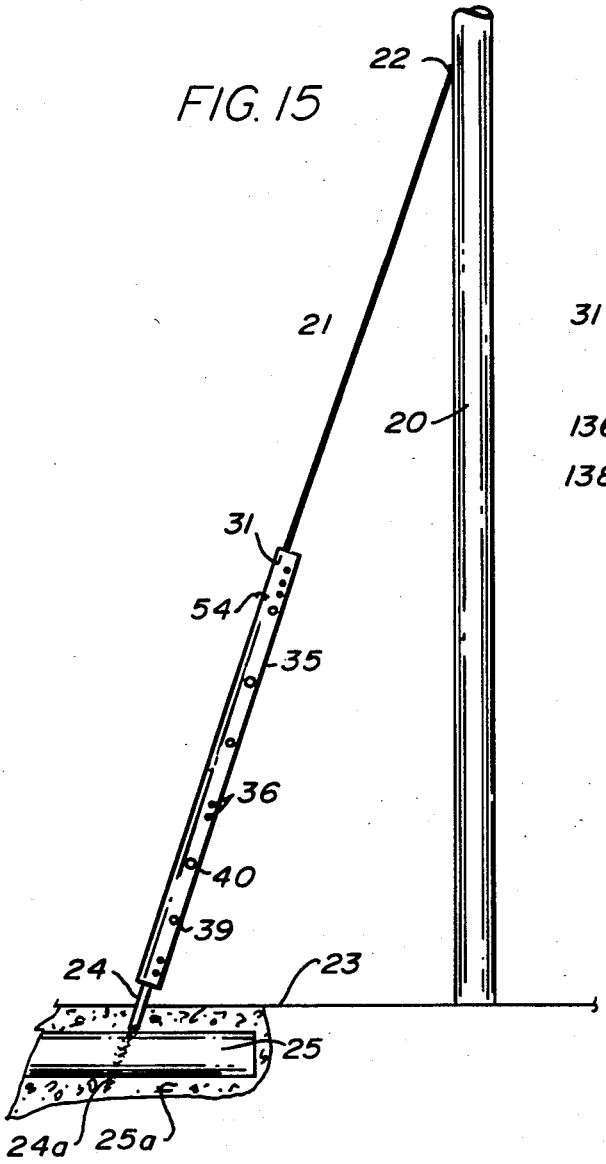
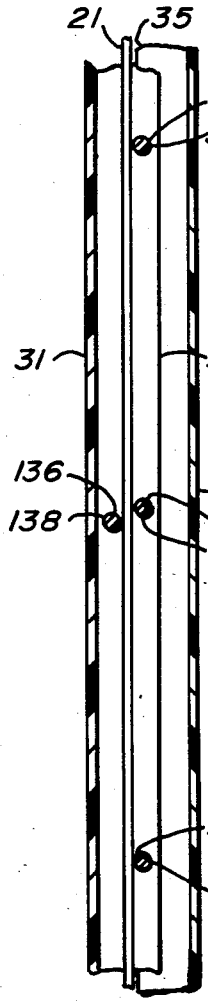
FIG. 19
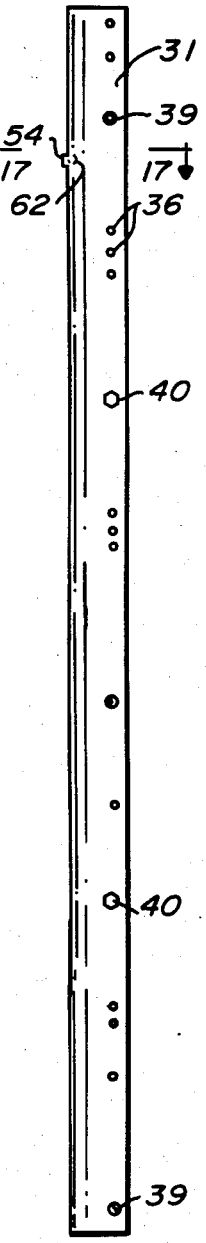
FIG. 16

FIG. 11
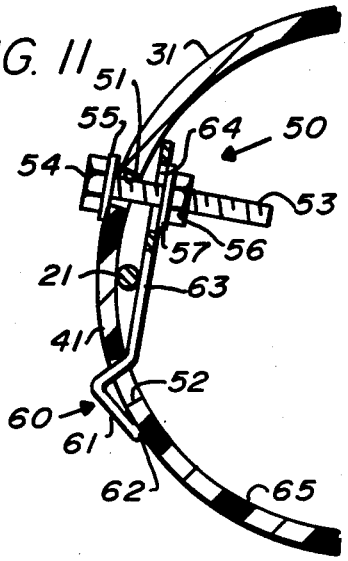
FIG. 12
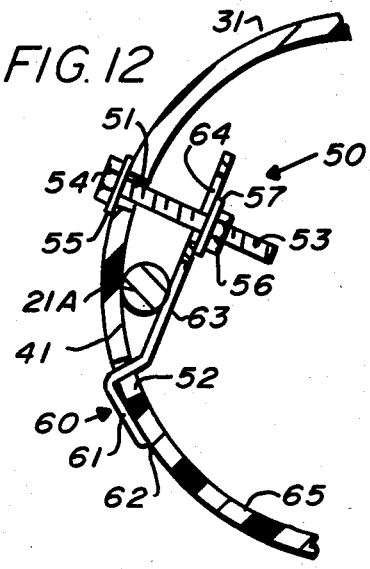
FIG. 13
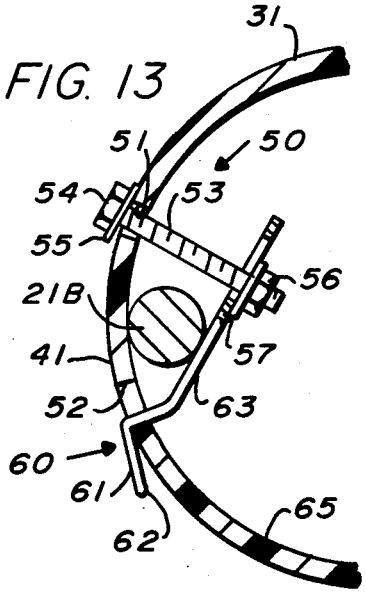
FIG. 14
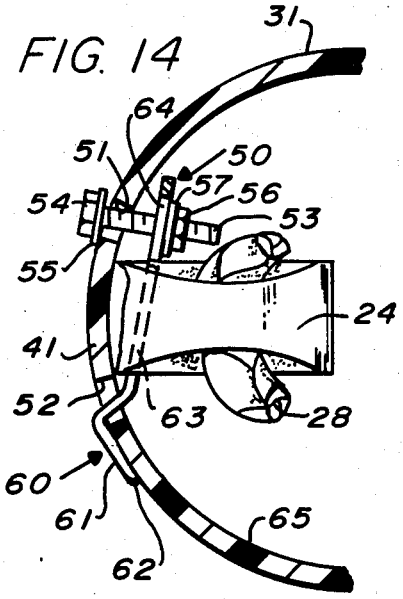
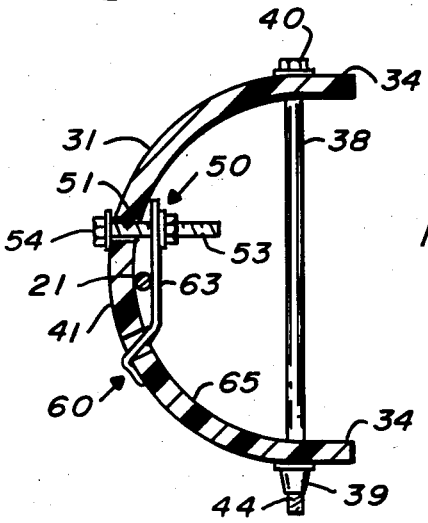
FIG. 17

FIG. 23
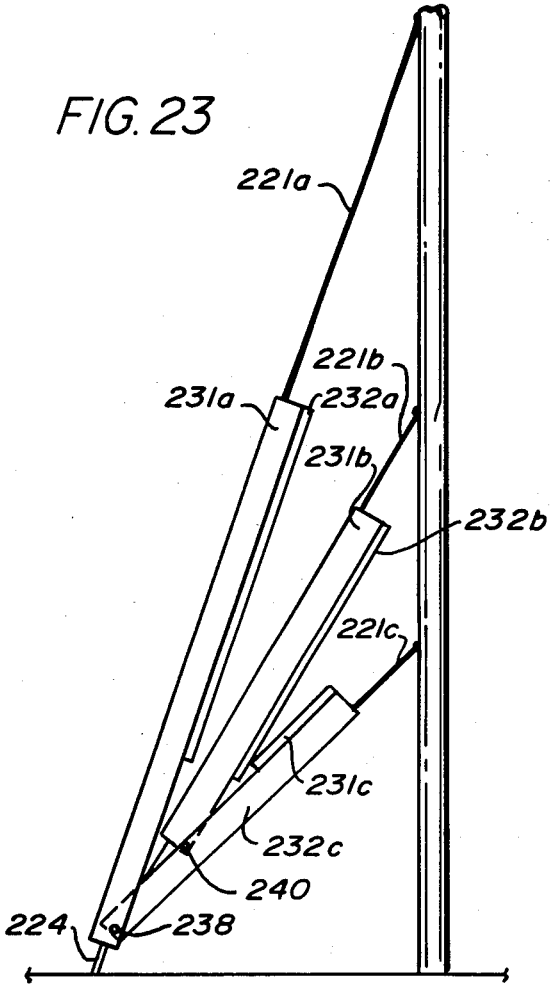
FIG. 24
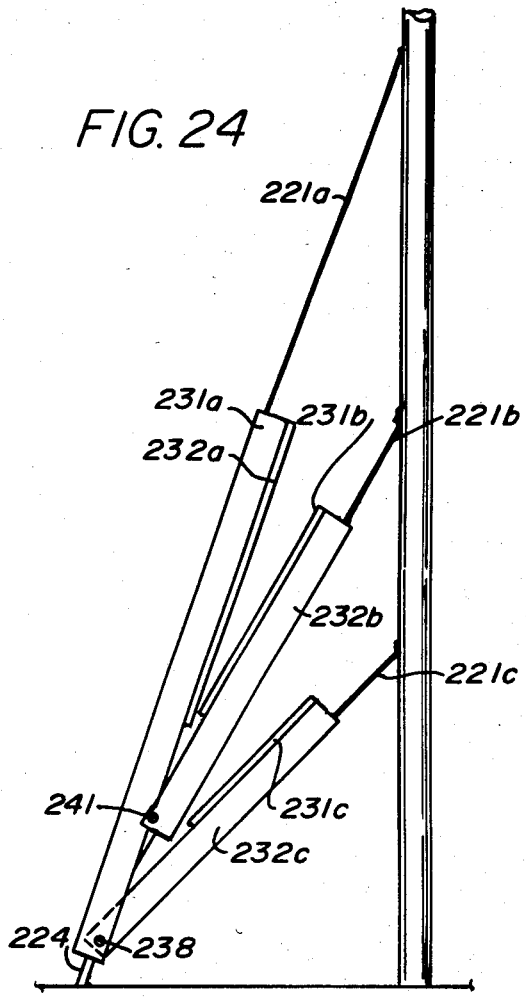
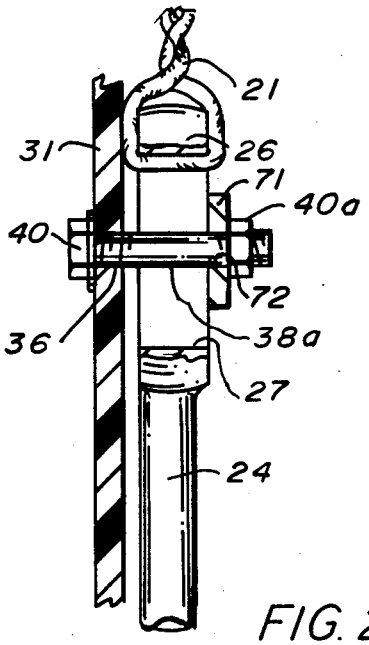
FIG. 25
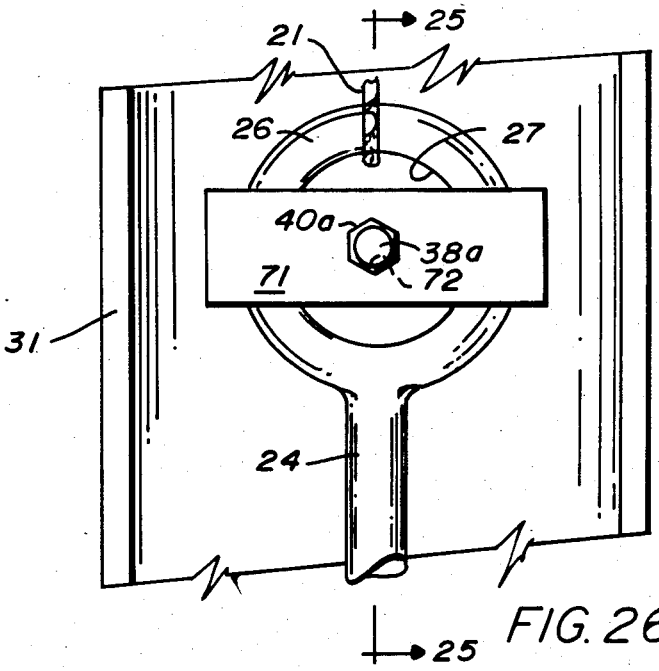
FIG. 26

GUY-WIRE GUARD ASSEMBLY AND FASTENING SYSTEMS THEREFOR

This invention relates to a guard assembly for protecting the public from bare guy-wires, their hardware, and anchor rods. The guy-wires are of the type used for utility poles, trees, and similar tall, ground-supported structures.

BACKGROUND OF THE INVENTION

Guards of this type are commonly used on guy wires of utility poles, which are located near walkways, yards, and streets where there is danger of injury to persons or damage to vehicles from impacts with a bare guy-wire. The guard assembly enhances the visibility of the guy-wire and in many cases prevents or reduces injury or damage from impact with it, as well as reducing such loss of utility service as is due to damage to the utility pole.

The earliest guy-wire guards in the electrical utility industry were made of wood, as the most available and least conductive material. (Dry wood is traditionally a safe material for touching a downed power line and avoiding electrocution). The California Public Utility Commission still states that all guy wire guards should be eight feet in length, made from a substantial material of either wood, metal, plastic, or other suitable material, thus showing the erstwhile primacy of wood as a guy wire guard.

The earliest wooden guards were as simple as a piece of approximately one-by-four-by-eight board. More sophisticated guards were approximately eight-by-one-by-three rectangular boxes; i.e., four boards nailed together. The most sophisticated wooden guards were bundles of eight-foot-long triangular-shaped slats lashed together by metal bands. All of these wooden guards were often painted black and white like the old railroad crossing barriers.

With the advent of the telephone industry and its utility poles, which do not carry power sufficient to electrocute, metal guards made their appearance on the scene. Sales and Standards personnel argued that metal would outlast wood, was more difficult to vandalize, and was appropriate for telephone guy-wire guards. Furthermore, it was argued that metal would also be better for the electrical utilities, for the same reason. It was said that the chances of anyone being electrocuted by downed power lines was miniscule, compared to the savings in cost of replacement of wooden guards. However, the awareness of the public of their legal rights and the perception of utilities as "deep pockets" has made use of metal risky for guy-wire guards.

With the advent of plastics, various plastic guards became popular among both the telephone and electrical utilities. It was argued that they would last longer than wood, were safer and less expensive than metal, and were lighter and easier to handle and store than either wood or metal. Plastic guards practically became a fad among both types of utilities, until it was discovered that they degraded and broke up under prolonged subjection to the ultraviolet content of sunlight, and that they were easily vandalized, i.e., were easily twisted, pushed up, or pulled down on the guy-wire.

Guy-wire guards made of plastic, especially polyethylene, not only broke down, i.e., were degraded by micro-cracks and disintegrated from ultraviolet penetration. They also burned easily, creating a new danger in outlying farm and wooded areas. Moreover, as time went on, these plastic guards were made less and less substantial in order to outweigh the labor-intensive cost of replacing them. The less substantial they became, the more easily vandalized or damaged from impacts they became, and, consequently, the less they protected the public and the pole.

The trend in the industry then became to move back to metal guards and take the chance of liability suits involving personal injury and wrongful death. Another trend in the industry was to move to only polyvinyl chloride guards, which would not burn, but they still broke-up under the exposure to ultraviolet light. No company wanted to buy high-ultraviolet resistant, exterior guards of polyvinyl chloride because of their initial expense and their high replacement costs when they were damaged by vehicle impacts and vandalism.

All of the above-described types of guards used fastening systems that allowed impacts from vehicles or vandals to bump them loose from the guy wires.

Furthermore, the fasteners used on most previous guards were made of galvanized metal. When a galvanized nut was threaded on a galvanized bolt, the threading would break the galvanized coating, and then rust would form under the broken coating and eventually cause the fasteners to disintegrate, so that the guard would eventually fall off the guy-wire.

Most of the previous guards used fasteners that fitted tightly on the guard and the wire. The tension on the guy wire would cause them to loosen under vibration. Also fasteners that were tightened down firmly would tend to crack plastic guards, especially in the presence of ultraviolet radiation, or, in the case of metal guards, the tight fit would (as said) break the galvanizing and lead to rusting.

Most guards previously designed did not cover the anchor rod down to the ground. In fact, many plastic guards were designed to cover the wire only above the anchor rod and hardware clamps (used to form a loop where the wire doubled back on itself), leaving the anchor rod, hardware, and wire tails exposed and creating the hazard of tripping pedestrians or injuring them with the exposed sharp edges.

Lastly, all previous guards, with the exception of the W. C. Vaughn guard (U.S. Pat. No. 4,223,491), were not designed to house the guy-wire completely, including the anchor rod, looping hardware and dangerously sharp wiretails.

The present invention is an attempt to solve these problems that have been associated with previous guards.

Previous attempts to solve the general problem are illustrated by U.S. Pat. Nos. 1,485,994; 1,630,356; 1,645,748; 1,765,823; Re. 19,639; 1,995,503; 2,880,828; 3,057,443; 3,173,519; 3,251,161; 3,425,456; 3,900,697; and 4,223,491.

In a typical present day situation, such as a utility pole, the guy-wire extends from a connection high up on the pole down to a ground anchor, which typically includes a rod having an eye through which the guy-wire is looped, the wire then being brought back on itself and held with clamps or other wire grippers. Preferably, a guard for such a guy-wire desirably covers the wire from a level somewhere near the ground anchor up to a level of about 8 feet or more above the ground.

An object of the present invention is to provide a guy-wire guard assembly, which is economical to manufacture, is simple to install, and when installed is difficult to bump loose, vibrate loose, or vandalize.

Visibility is an important feature of all such guards, and it is an object of the invention to provide improved visibility as well.

Most guards, heretofore, have either been open for about half their periphery or have been very small in diameter, so that, although they would cover the guy-wire itself, they could not cover the anchor at the ground or any enlarged portions. Also, such small-diameter guards were not very visible, nor were they substantial.

Vandalism has been a major problem with these guards; for, some people, including children, often seem to delight in damaging or destroying them. They sometimes twist them or pull them partly away from the guy-wire, push them up the guy wire, or otherwise mishandle them, so that the guards are no longer able to perform their function properly. This often happens with guards which are large enough in diameter to be used properly for visibility when new, but which protect only one side of the wire, so that the vandals can get at their interior as well as their exterior. Another problem with such guards is that damage from vehicles that pump into them easily dislodges them from the guy-wire.

Another problem with guard assemblies, heretofore, has been the difficulty of adequately securing them in a way which deters dislodging from impacts, vibration, and vandalism.

A further problem confronting these guard assemblies has been to protect them from the weather, especially where it may be relatively severe, for example, very hot in the summer and very cold in the winter. Ultraviolet rays, as said above, have tended to cause micro-cracking and eventual deterioration, so that the guards have often literally crumbled off the wire.

An additional problem has been to prevent damage from fire, for where polyethylene plastic guard members have been used, they have often been found to be quite inflammable.

Another problem with the prior-art types of plastic guards has been that they have been too flexible and therefore too easy for vandals to distort.

A major attraction to vandals has been that the fastening members, especially when made so that they can be removed for replacement or the like, have been too easily removed. Where the fasteners have not been readily removable, they have commonly corroded or rusted so that they were substantially useless after a while.

Metal guard assemblies have been often relatively rigid compared with those of plastic, but those of the prior art have been readily damaged; when they were bent by vehicle impact, they stayed bent and formed sharp edges that created an additional hazard. Even the best metal guard assemblies have presented hazards in storms, for they are conductors of power, when damage done by a storm sends power to them or when lightning struck them. Also metal guards have been quite expensive.

It is important that guard assemblies be recognized by the employees of the power companies and other such companies as being safe both from an electrical standpoint and from a physical standpoint, for some structures may cut or injure workers, as well as the public, and in other ways make the entire installation more dangerous than it was as a bare guy wire.

SUMMARY OF THE INVENTION

The present invention comprises a guy-wire guard assembly which comprises one (or, preferably, a pair of) elongate generally channel-like or semi-tubular body (or bodies) of weather-resistant, ultra-violet resistant impact-resistant, and substantially rigid plastic material. A preferred material is an ultraviolet-resistant, exterior grade of polyvinyl chloride. As viewed from one end or in cross-section, each body (especially when used in pairs) preferably has a 180° arcuate portion, and at each end of that portion has a straight extension portion. When arranged in a facing pair, the two extension portions are generally parallel to each other.

Upon installation, a single body gives coverage of about half of the guy wire, while the use of a pair of bodies gives full coverage. For use of a single body, there are bolts passing across, on the opposite side of the guy wire from the arcuate portion.

For use as a pair, the two bodies are aligned so that their arcuate portions face each other on opposite sides of the guy-wire and the ground anchor. Preferably, the installation begins at about ground level and extends up to a height of about eight feet. The extension portions of the two bodies then overlap each other, and the extension portions of the same body lie diametrically opposite each other. Two series of diametrically opposite, aligned bolt-receiving openings through these overlapping portions are adapted to be aligned with each other so that the body itself encloses, with plenty of clearance space, the guy-wire, the ground anchor, and its hardware, including sharp wire tails.

These two bodies are secured to each other by a plurality of bolts, which may extend diametrically across the overlapping bodies and through four openings there. That is, there are two openings on each side of the guy-wire, one for each body on each side. Alternatively, or in addition, bolts may pass through the arcuate portions of the two bodies. Each bolt has a head at one end and preferably has a vandal-resistant nut threaded on the other end, so that it is very difficult to remove the bolts, that is, to unthread the bolt from the vandal-resistant nut. Yet, no special tools are required for installation. One of these bolts is usually located near the lower end of the body and may pass through the eye of the ground anchor or through the wire loop. If that is too far above ground level, it is possible to have one bolt near the end and another one near the eye. Another bolt is located near the upper end of the installation. There may be some additional bolts and nuts, depending on the total length of the guard bodies.

In addition to this, at least one guard body has at least one pair of openings through its arcuate portion. These openings are about 15° or 20° apart, and lie on the same circumferential arc. Preferably both bodies have such openings and two, three, or more of them. These openings may be utilized by a novel fastener combination provided by the present invention, which gives additional protection to the guy-wire and to the guard.

This fastener combination, which is called a "lip fastener", comprises two parts, one being a sub-assembly, namely a bolt member with a head on its outer end adapted to abut against the outer wall of the guard body or against a washer placed thereon, and a nut at its inner end. The other member of the combination is a locking washer, of universal structure, having a flat portion with an oval opening through it and a main axis oriented longitudinally of the flat portion. The bolt passes through that oval opening between the head and the nut, and an end tab of the locking washer member extends at an angle, preferably approximately perpendicularly, from one end of the flat portion to a hooked outer end that goes through the other fastener opening and engages the outer wall of the adjacent guard body. These fastener members are used to engage the guy-wire and hold it against the guard body. They are installed before the second member of the pair of guard members is secured in place.

In some instances a pair of such lip fasteners is used to engage a ground anchor and hold it against or substantially against the interior of one of the guard bodies. This combination positively locates the guy-wire or ground anchor within the guard body assembly, and thereby helps also to prevent displacement or damage.

The fasteners are ideally made of nonconductive materials, such as Teflon, etc. which also do not corrode. If that is not cost-effective, then all fasteners are preferably made of stainless steel, which will not corrode.

BRIEF DESCRIPTION OF THE DRAWINGS

FIG. 1 is a view in side elevation and partly in section of a pole having a guy-wire leading to a ground anchor rod and with a guard assembly embodying the principles of the invention surrounding the upper portion of the ground anchor rod and the lower portion of the guy-wire.

FIG. 2 is a view in side elevation and on an enlarged scale of an assembled guard embodying the principles of the invention, the guard being that shown in FIG. 1.

FIG. 3 is a further enlarged view in section taken along the line 3—3 in FIG. 2.

FIG. 4 is an enlarged view in section of the lower left hand portion of FIG. 1 showing the guard surrounding the lower part of the guy-wire and the upper part of the ground anchor rod and also covering the sharp wire tail.

FIG. 5 is a fragmentary enlarged view in elevation of some portions of the guard of FIGS. 1–4, with breaks between them; it shows some of the bolt connections.

FIG. 6 is a further enlarged view in section taken along the line 6—6 in FIG. 5.

FIG. 7 is a top plan view of a portion of one of the fastening elements of the lip fastener combination embodying the present invention.

FIG. 8 is a view in section taken along the line 8—8 in FIG. 7.

FIG. 9 is a fragmentary view partly in section of an attachment of a bolt to a vandalproof nut that is clamped against the walls of the guard.

FIG. 10 shows the same structure with the vandalproof nut fully tightened and the part which enabled its fastening and unfastening broken off.

FIG. 11 is a fragmentary enlarged view of a portion of a guard of the invention with a very small diameter guy-wire clamped to the guard by the fasteners of FIGS. 7 and 8.

FIG. 12 is a similar view, with a larger-diameter guy-wire shown.

FIG. 13 is another similar view showing a still larger diameter guy-wire.

FIG. 14 is a similar view of an eye bolt clamped by the fastening members.

FIG. 15 is a view in side elevation and partly in section, like FIG. 1 but with only a single guard member, for applications where the guy-wire does not need to be completely surrounded.

FIG. 16 is an enlarged view generally like FIG. 2, but with the single guard member, as in FIG. 15.

FIG. 17 is a further enlarged view in section taken along the line 17—17 in FIG. 16.

FIG. 19 is a fragmentary view in side elevation and in section of a 360°-guard assembly in which an additional, i.e, a fourth, bolt is provided to prevent the guy-wire from being bumped repeatedly against one or both of the guard members.

FIG. 23 is a view similar to FIG. 21 of a modified form of the present invention.

FIG. 24 is another view similar to FIG. 21 of another modified form of the present invention.

FIG. 25 is an enlarged view in section taken along the line 25—25 in FIG. 26.

FIG. 26 is an enlarged view looking from below into a single guard member where it is attached to an eye of an anchor rod, using a flat plate fastener.

DESCRIPTION OF SOME PREFERRED EMBODIMENTS

Figure 18:
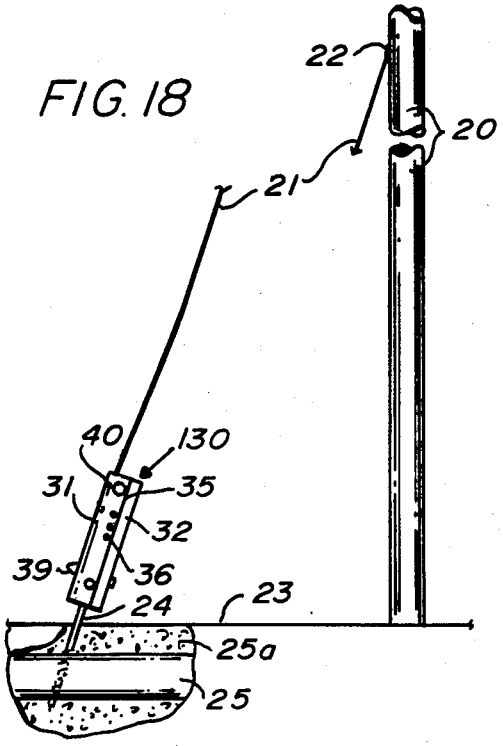
FIG. 18 is a view generally like FIG. 1 but with an upper portion broken and with a short 360°-guard assembly near the bottom of the guy wire.

As FIG. 1 shows, a typical installation may embody a utility pole 20 with a guy-wire 21 secured to the pole 20 at a point 22 near its upper end and extending down at an angle thereto, down to nearly ground-level 23. At point somewhat above ground level 23 the guy-wire 21 is connected (see FIG. 4) to a ground anchor member 24, which typically has a threaded lower end **24*a* screwed into a pole 25 that is embedded in concrete 25*a*. As shown in FIG. 4, the ground anchor rod 24 is provided near its upper end 26 with an eye 27. A free portion 28 of the guy-wire 21 is looped through the eye 27 and then is secured back on the guy-wire 21 itself, as by a conventional plate-and-bolt combination 29. A sharp wire tail 29*a*** results, and this can be dangerous to the public without some guard. Other installations are possible, but this typical one illustrates one current practice.

As FIGS. 1 and 4 show, most of the ground anchor rod 24 that extends above the ground level 23 and the first few feet of the guy-wire 21 above it, including the tail **29*a* are enclosed in a guard body assembly 30 embodying the principles of the present invention. This assembly 30 typically comprises two semi-tubular or channel-like members 31 and 32** of strong, substantially rigid plastic, with high-impact resistance. Preferably, the material is an ultraviolet-resistant, exterior grade of polyvinyl chloride in a thickness appropriate for the desired degree of rigidity; e.g., about ⅛ inch. This material does not burn or ignite in the presence of a flame, nor is it conductive. Metal or fiberglass or other appropriate material may be used instead.

Each of these guard members 31 and 32,—they may be substantially identical—preferably has a 180° arcuate portion 33 (FIG. 3) and from each end of the arcuate portion 33 an integral extension portion 34 or 35 extends out like a tangent at the ends of the semi-circular portion 33. These portions 34 and 35 extend far enough so that when the two members 31 and 32 are put together with their arcuate portions 33 diametrically opposite each other, the extension portions 34 and 35 overlap each other, with one of them inside and the other outside. At convenient locations, which may depend upon the particular installation or may be standardized, these extension portions 34 and 35 are provided with through openings 36 and 37 (FIG. 3) which may be easily aligned with each other, so that a bolt 38 can pass through the guard 30 and be fastened by a nut 39. The guard assembly 30 completely encloses the upper portion of the ground anchor rod 24 and the lower part of the guy-wire 21. The ground anchor rod 23 being larger in diameter than the guy-wire 21, may have a relatively small clearance from the guard 30 especially at the eye 27 (FIG. 4), while between the guy-wire 21 and the guard 30 will be a substantial clearance.

The assembly is secured in this manner by at least two and often more bolts 38, which go through the four openings 36, 37 at each such location. As shown in FIGS. 9 and 10, each bolt 38 has a head portion 40 that may bear directly against the outer surface 41 of one guard body member 31 or 32 or, preferably, bears against a washer 42 that lies against that surface 41, while the shank 43 of the bolt 38 extends through the entire enclosed area and projects out the opposite end. At this point a threaded end 44 of the bolt is secured by a suitable nut 39 (FIGS. 3, 6, 9, 10 and 17).

This fastening system of cross-pinned bolts allows the guard 30 to capture the wire 21 between the bolt 38 and the back of the guard 30, helping to eliminate the tension which leads to cracking.

Nuts 39 are available on the market which guard against vandalism and may be (and preferably are) used with this invention. These nuts 39, as originally installed, appear as in FIG. 9. They comprise a frustoconical portion 45 joined by a short cylindrical portion 46 to a keyed head 47, such as a hexagonal head. The interior of the frustoconical portion 45 is threaded, and at its upper end the portion 46 is weakened by a circular indentation 48. Therefore, after installation is made by using the hexagonal head 47, further wrenching force on the head 47 results in its being broken off, as in FIG. 10, leaving only the conical portion 45, which is very difficult indeed to remove. Wrenches will not suffice, nor will pliers; so that the installation becomes substantially vandal proof. The use of the two guards 31 and 32 completely houses the guy-wire hardware and makes it virtually impossible to remove.

If desired, and as shown in FIGS. 5 and 6, further bolts 38 may also extend diametrically through from one of the arcuate portions 33 to the opposite one to give further tightening of the guard 30. This is called pinning from crown to crown and may be used as an alternative way of joining the two members 30 and 31 together. If desired, such a bolt 38 may extend through the eye 27, as shown in FIG. 6. Depending on the orientation of the eye 27 of the guard member, one of the bolts 38 through the overlapping portions may go through the eye 27 (FIG. 4).

A very useful portion of this invention is a special lip fastener assembly 50, shown best in FIGS. 5–8 and 11–14. In order that this assembly 50 may be employed, at least one of the guard bodies 31, 32 is provided with at least one pair of openings 51 and 52 about 15° or 20° apart through the 180° arc portion 33, preferably centered with respect thereto (FIGS. 11–14). It is desirable that there be more than one such pair of openings. They may be on both guard bodies 31 and 32 or may all be on one of them.

At each of these pairs of openings 51 and 52 a fastening system 50 is applied. This comprises a sub-assembly and a cooperating member. The subassembly comprises an ordinary threaded bolt 53 that extends loosely through the unthreaded opening 51 (or 52), with a head 54 which may abut the body member 31 or 32 or may bear on a typical washer 55 that bears on the body member 31 or 32. Inside the guard member 31 or 32, at the end of the bolt 53, a nut 56 and a washer assembly 57 may be applied.

The cooperating member 60 (see also FIGS. 7 and 8) has a hooked, outer-end tab portion 61. This tab portion 61 is insertable from inside through the other opening 52 (or 51) of the pair, and a terminal part 62 lies against the outer wall 41 of that guard body 31 or 32. The member 60 also includes a flat rectangular portion 63 that lies inside the guard body 30 and is provided with an oval opening 64 having its major axis oriented longitudinally of the flat rectangular portion 63. The threaded bolt 53 extends through the oval opening 64, the shape of which enables adjustment of the bolt 53 relatively to the member 60 in various positions, the angle at which the portion 63 meets the bolt 53 thereby varying. The plate 60 lies between the bolt's head 54 and the nut 56 and therefore also between an inner wall 65 of the guard body member 31 or 32 and the nut-washer combination 56, 57.

The nut 56 can be threaded up to any desired position, so that the guy-wire 21 or the ground anchor member 24 may be secured between the flat plate member 60 and the wall of the guard body 60. Depending on the diameter of the wire 21 the angle of the flat plate member 60 to the bolt 53 will, of course, be varied. A large number of sizes can be accommodated; some are shown in FIGS. 11, 12 and 13, where there are guy-wires 21, 21A, 21B, and may vary between about $\frac{1}{8}''$ in diameter to about $\frac{5}{8}''$ in diameter. It is typical to use a different size member 60 for the anchor rod 24 than for the guy-wire 21 (FIG. 14).

Thus, the completed unit of FIG. 1 comprises the two guard body members 31 and 32, their fastening bolts 38, and a sufficient number of fastening members 50 to achieve the desired results.

For installations where complete encirclement is not required or desired, money can be saved by using the simpler installation shown in FIGS. 15–17, 25 and 26. Here only a single guard element 31 is used. Cross-pinning bolts 38 help hold the guard element 31 on the guy-wire 21, the bolts 38 lying on the opposite side of the guy-wire 21 from the arcuate portion 33. The lip fasteners 50 are used as before. The structure of FIGS. 15–17 is quite practical for many installations but the structure of FIGS. 1–3 is better wherever attempts at vandalism are to be expected.

When, as in FIGS. 25 and 26, a single guard element 31 is used and when the eye 27 of the guy wire 21 is oriented to lie in a plane perpendicular to the plane of the guy wire 21 that is perpendicular to the ground, a bolt 38*a* through the center of the arc of the member 31 is used in conjunction with a flat plate fastener 71 about three inches long having a central opening 72 and against which a nut 40*a* abuts. In this way, the eye portion 27 may be clamped against the member 31.

In other installations, the full eight-foot height is not needed, and FIG. 18 shows a guard assembly 130 that is like the assembly 30 except for length. This assembly 130 protects the juncture of the guy-wire 21 with the ground anchor rod 24. It may be used, if desired, with an upper guard section that is only slightly larger than the diameter of the guy wire 21.

Since the guard 30 rests on the guy-wire 21, it tends to rattle when bumped. For companies that object to the potential noise when the wind rattles the guard, a lip fastener 50 should be placed preferably in the middle of the guard 30. This prevents wind rattle and still allows a warning noise when bumped at the top and bottom cross-pinnings.

Cross-pinning a fourth bolt 138 against the guy wire 21 also can be used to eliminate rattlings. This alternative is shown in FIG. 19. The bolt 138 is placed nearly opposite a middle bolt 58 and creates tension that holds the guard steady in the face of wind. Two holes 136 in the guard member 31 are located out of line with the holes 36, being further from the free edges of the member 31. The holes 136 are so located, relative to the holes 36 that the bolt 138 and the bolts 38 bear on opposite sides of the guy-wire 21 and hold it snugly between them. Again, wind rattle is prevented.

Figure 20:
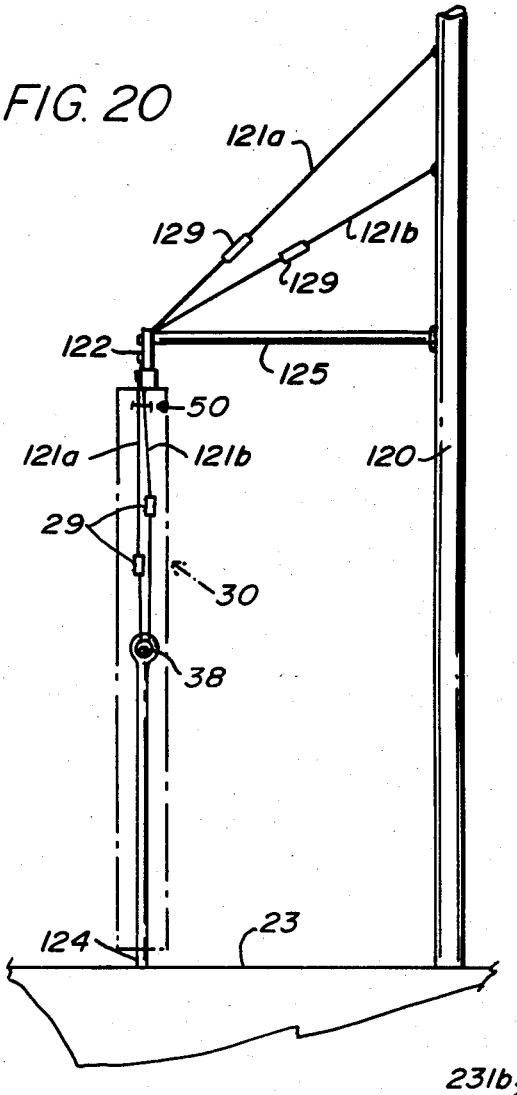
FIG. 20 is a view in elevation of a "Queen's Post" type of structure employing the present invention. The guard is shown in dot-dash lines to show the ground anchor and guy wires.

FIG. 20 shows an alternative type of structure commonly known as a "Queen's Post". A utility pole 120 is paralleled by a tall ground anchor rod 124, to the top of which are secured a pair of guy wires 121 and 121*b* extend up vertically and then pass through a sleeve 122 fastened to the outboard end of a horizontal member 125. Above the member 125, the guy wires 121*a* and 121*b* extend up at an angle and are attached to the pole 120, with insulators 129 to prevent electrical conduction. The invention is just as useful in this type of installation as in the structure heretofore shown. Here, the guy-wires 121*a* and 121*b* need no guard above the horizontal member 125, but the rod 124 and most of the the portions of the guy wires 121*a* and 121*b* below the member 125 do. A two-member guard 30, like that already described, is used for this purpose. A lip fastener 50 may be used to tie the guard 30 to the guy wire 121*a* or 121*b*.

Figure 21:
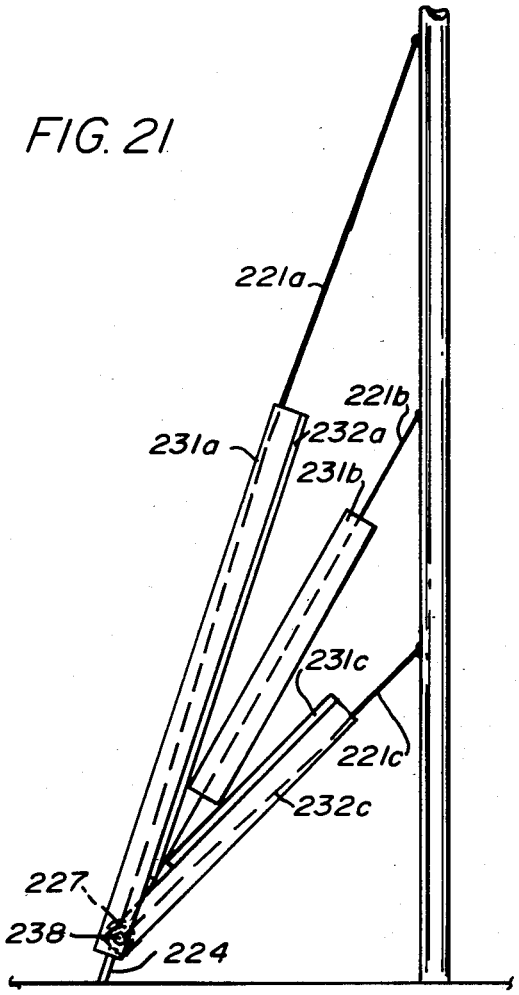
FIG. 21 is a fragmentary view in side elevation of a juncture of three guy-wires at one anchor rod, showing the use of the present invention to provide greater child safety. Bolts, etc., have been omitted for simplicity's sake, and the eye of the ground anchor rod is shown in broken lines.

FIG. 21 shows an example of a special problem: guarding the anchoring a plurality of guy-wires to an anchor rod. Here, guy-wires 221*a*, 221*b*, and 221*c* are secured to a single eye 227 of an anchor rod 224. Free ends of the guy-wires 221*a*, 221*b*, and 221*c* are each looped back and are held to themselves by conventional plate-and-bolt or other combinations like the one shown in FIG. 4. This structure can be an attractive nuisance, and unaware children can get into it and strangle themselves.

To solve this problem, the eye portion of the ground anchor rod 224 is partly surrounded by a guard member 231*a*, which protects the wire 221*a*. Wires 221*b* and 221*c* emerge from the open side of this guard member 231*a*. A bolt 238 passes through openings near the bottom of this guard member 231*a* and through the eye 227. Above that, the lower portions of the guy-wires 221*a*, 221*b*, and 221*c* are protected by the three respective guard members 232*a*, 232*b*, and 232*c*, inverted with respect to the guard member 231*a* (which may be like the guard member 31). The guard members 232*a*, 232*b*, and 232*c* may be generally identical to the guard member 231*a* and the upper sides of the wires 221*b* and 221*c* are protected by guard members 232*b* and 232*c*. Only a very small area is left unprotected, and it would be very difficult for a child to get into it.

Figure 22:
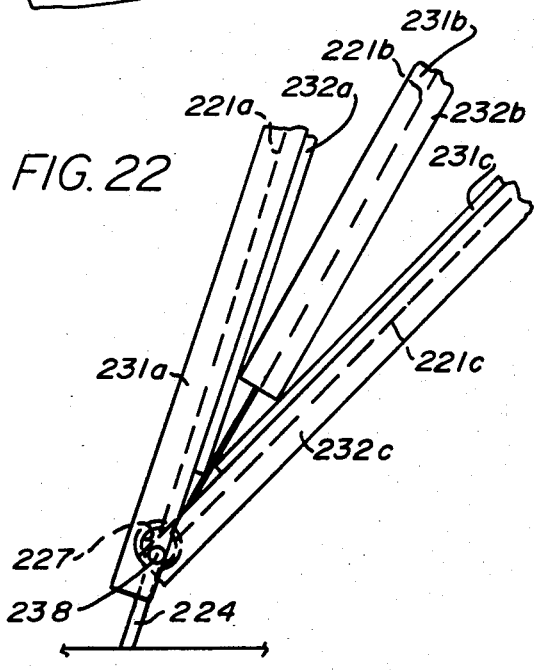
FIG. 22 is a fragmentary enlarged view of the lower portion of FIG. 21.

FIGS. 23 and 24 show structures much like those of FIGS. 21 and 22. In FIG. 23, the lower center guard member 231*b* is held to the lower guard member 232*c* by a pin or bolt 240. In FIG. 24, the upper center guard member 232*b* is similarly pinned by a pin or bolt 241 to the upper guard member 231*a*.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A guard assembly for a guy-wire connected to a ground anchor rod, said guard assembly comprising an elongate generally semi-tubular body having an arcuate, generally semicircular portion and at each end thereof a tangentially extending extension portion, said extension portions being parallel to each other, said body having an inner wall and an outer wall, a plurality of bolts, each extending diametrically across the body between said parallel extension portions, each bolt having a head at one end and a nut threaded on the other end, to secure said body around said wire, so that the wire lies between the bolts and the arcuate portion of said body, one said bolt being near the lower end of said body, and another said bolt being spaced therefrom and near the upper end of said body, said guard body having at least one circumferentially aligned pair of fastener openings through its said arcuate portion, and a fastener combination for each said pair of fastener openings for holding the guy wire or rod against the inner wall of said body, comprising two principal members, namely a bolt member with a head bearing on said outer wall outside the guard assembly and extending inwardly through one said fastener opening to a nut at its inner end and a locking washer member inside said guard assembly, having a flat portion with an opening therethrough, said bolt-like member passing through said opening inside the area enclosed by said guard assembly, between said head and said nut, and an end tab of said locking washer member extending out at an angle from one end of said flat portion to a hooked outer end extending through the other said fastener opening and engaging the outer wall of the adjacent guard body, whereby either the guy wire or the ground anchor rod can be clamped between said guard body and said flat portion in a location between said bolt member and said end tab.

2. The guard assembly of claim 1 wherein said body is made of weather-and-impact-resistant, generally rigid plastic.

3. The guard assembly of claim 2 wherein the plastic is ultraviolet resistant, exterior grade polyvinyl chloride.

4. The guard assembly of claim 2 wherein the plastic is ultraviolet resistant fiberglass-epoxy material.

5. The guard assembly of claim 1 wherein the bodies are metal.

6. The guard assembly of claim 1 having a series of spaced-apart bolt-receiving openings through said extension portions for receiving said bolts at various regular spacings.

7. The guard assembly of claim 1 in which all the nuts exposed outside the enclosed area are of a vandal-resistant type, wherein a keyed portion used to tighten them is broken off at the completion of the installation of each one.

8. The guard assembly of claim 1 wherein said opening through the flat portion of said locking washer member is oval and extends longitudinally of said washer member.

9. A guarded guy-wire and ground anchor rod assembly comprising a ground anchor rod secured permanently at a base and extending upwardly, a guy wire secured at its lower end to said rod and extending upwardly therefrom, an elongate generally tubular body having a generally semicircular arcuate portion with a tangentially extending extension portion at each end, said extension portions being parallel to each other, said body having an inner wall and an outer wall, a plurality of bolts, each extending diametrically across the two parallel extension portions, each bolt having a head at one end outside the body assembly bearing on said outer wall and a nut threaded on the other end outside said body assembly and bearing on said outer wall, one said bolt near the lower end of said body connecting said body to said ground anchor rod, other said bolts being spaced therefrom at intervals up to a locus near the upper end of said body, said guard body having at least one pair of circumferentially aligned fastener openings through its said arcuate portion, and a fastener combination for each said pair of fastener openings, comprising a bolt-like member with a head on its outer bearing on said outer wall end and extending inwardly through one said fastener opening to a nut at its inner end and a locking washer member having a flat portion with an opening therethrough, said bolt-like member passing through said opening between said head and said nut, and an end tab of said locking washer member extending at an angle from one end of said flat portion to a hooked outer end that extends through the other said fastener opening and engages the outer wall of the adjacent guard body, said guy wire being clamped against said guard body by said fastener combination between said inner wall and said flat portion and between said bolt-like members and said hooked end of said washer.

10. The assembly of claim 9 wherein said ground anchor rod has an eye at its upper end and the bolt connecting said body to said anchor rod extends through said eye, and a plate extends across the eye against which bears a nut that secures the bolt.

11. The assembly of claim 9 wherein said opening through said flat portion of said locking washer is an oval having its main axis oriented longitudinally of said flat portion.

12. The assembly of claim 9, wherein said guy wire has a loop where it is connected to said ground anchor rod, and the bolt connecting the body to the anchor rod extends through said loop.

13. The assembly of claim 9 wherein said assembly has a series of such fastener combinations and openings, each clamping the guy wire to said guard body.

14. The assembly of claim 9 wherein there is also another fastener combination and pair of openings for clamping said guard body against the upper end of said ground anchor rod.

15. The assembly of claim 9 wherein all the nuts exposed outside the enclosed area are of a vandal-resistant type, wherein a keyed portion used to tighten them is broken off at the completion of the installation of each one.

16. The assembly of claim 9 wherein said plurality of bolts includes at least three bolts on one side of said guy wire and a fourth bolt on the opposite side of said guy wire, facing a bolt that lies in between two other said bolts, the fourth bolt and its adjacent bolt holding the guy wire in tension between them.

17. The assembly of claim 9 wherein the bodies are made of weather-and-impact-resistant, generally rigid plastic.

18. The assembly of claim 17 wherein the plastic is ultraviolet-resistant, exterior grade polyvinyl chloride.

19. The assembly of claim 9 wherein the bodies are metal.

20. A guard assembly for an installation wherein a guy-wire is connected to a ground anchor rod, said guard assembly comprising a pair of elongate generally semi-tubular guard bodies each having a 180° arcuate portion and at each end thereof a straight extension portion, the two extension portions being generally parallel to each other, the two bodies being assembled together so that the extension portions of one body are in contact with and overlap those of the other, there being two pairs of overlapping extension portions diametrically opposite each other, the two arcuate portions also being diametrically opposite each other, said bodies when assembled being adapted to enclose a portion of said installation, a plurality of bolts, each extending diametrically across the assembly, each bolt having a head at one end and a nut threaded on the other end, to secure said pair of bodies together, one said bolt being near the lower end of said body, and another said bolt spaced therefrom and near the upper end of said body, at least one said guard body having at least one circumferentially aligned pair of fastener openings through its said arcuate portion, and a fastener combination for each pair of fastener openings, comprising two principal members, namely a bolt member with a head outside the guard assembly and extending inwardly through one said fastener opening to a nut at its inner end and a locking washer member having a flat portion with an opening therethrough, said bolt-like member passing through said opening inside the area enclosed by said guard assembly, between said head and said nut, and an end tab of said locking washer member extending out at an angle from one end of said flat portion to a hooked outer end extending through the other said fastener opening and engaging the outer wall of the adjacent guard body, for clamping a portion of said installation to said guard body.

21. The guard assembly of claim 20, wherein said opening through the flat portion of the locker washer member is oval, with its main axis oriented longitudinally of said flat portion.

22. The guard assembly of claim 20 wherein the bodies are made of weather-and-impact-resistant, generally rigid plastic.

23. The guard assembly of claim 22 wherein the plastic is ultraviolet-resistant, exterior grade polyvinyl chloride.

24. The guard assembly of claim 22 wherein the plastic is an epoxy resin-fiberglass combination.

25. The guard assembly of claim 20 wherein the bodies are metal.

26. The guard assembly of claim 20 having a series of spaced-apart bolt-receiving openings through said extension portions for receiving bolts at various regular spacings, said bolts extending across between said extension portions, each bolt passing through for said openings, that is, two for each body.

27. The guard assembly of claim 26 also having a series of spaced apart bolt-receiving openings through the centerline of said arcuate portion and bolts extending through them diametrically across the assembly.

28. The guard assembly of claim 20 having a series of spaced-apart bolt-receiving openings through the centerline of said arcuate portion, said bolts extending therethrough diametrically across said assembly.

29. The guard assembly of claim 20 wherein all the nuts exposed outside the enclosed area are of a vandal-resistant type, wherein a keyed portion used to tighten them is broken off at the completion of the installation of each one.

30. A guarded guy-wire and ground anchor rod assembly comprising a ground anchor rod secured permanently at a base and extending upwardly at an angle, a guy wire secured at its lower end to said rod and extending upwardly therefrom, a pair of elongate generally tubular bodies each having a 180° arcuate portion with a straight extension portion at each end, the bodies being assembled to enclose most of said ground anchor rod and a substantial portion of said guy wire, said bodies being aligned so that the overlapping extension portions of each body are diametrically opposite each other and overlap corresponding portions of the other body, the two arcuate portions also being diametrically opposite each other, a plurality of bolts, each extending diametrically across the generally circular structure formed by said overlapping bodies and through said bodies, each bolt having a head at one end outside the body assembly and a nut threaded on the other end outside said body assembly, to secure said pair of bodies together and to fully enclose the guy-wire and ground anchor for the height of said guard bodies, one said bolt near the lower end of said body connecting said rod to said ground anchor rod, other said bolts being spaced therefrom at intervals up to a locus near the upper end of said body, at least one said guard body having at least one pair of circumferentially aligned fastener openings through its said arcuate portion, and a fastener combination for each pair of fastener openings, comprising a bolt-like member with a head on its outer end and extending inwardly through one said fastener opening to a nut at its inner end and a locking washer member having a flat portion with an opening therethrough, said bolt-like member passing through said opening between said head and said nut, and an end tab of said locking washer member extending at an angle from one end of said flat portion to a hooked outer end that extends through the other said fastener opening and engages the outer wall of the adjacent guard body, said guy wire being clamped against said one guard body by said fastener combination.

31. The assembly of claim 30, wherein the opening through the flat portion of said locking washer member is oval with is main axis oriented longitudinally of said flat portion.

32. The assembly of claim 30 wherein said rod is vertical and extends well above ground level, being spaced from said pole, and wherein there is a horizontal rigid member extending to an outboard end, a plurality of said guy-wires extending up vertically from from the upper end of said rod to the outboard end of said rigid member and then up at an angle to said pole, said bodies enclosing said rod from almost ground level to its upper end and said vertical portion of the guy wires thereabove.

33. The assembly of claim 30 wherein said ground anchor rod has an eye at its upper end and the bolt connecting said body to said anchor rod extends through said eye.

34. The assembly of claim 30, wherein said guy wire has a loop where it is connected to said ground anchor rod, and the bolt connecting the body to the anchor rod extends through said loop.

35. The assembly of claim 30 wherein said assembly has a series of such fastener combinations and openings, each clamping the guy wire to said one guard body.

36. The assembly of claim 30 wherein there is also another fastener combination and pair of openings for clamping said one guard body against the upper end of said ground anchor rod.

37. The assembly of claim 30 wherein all the nuts exposed outside the enclosed area are of a vandal-resistant type, wherein a keyed portion used to tighten them is broken off at the completion of the installation of each one.

38. The assembly of claim 30 wherein the bodies are made of weather-and-impact-resistant, generally rigid plastic.

39. The assembly of claim 38 wherein the plastic is ultraviolet-resistant, exterior grade polyvinyl chloride.

40. The assembly of claim 30 wherein the bodies are metal.

41. The assembly of claim 30 wherein said bolts that hold the guard assembly together comprise bolts extending across and between said arcuate portions.

42. The assembly of claim 30 wherein the overlapping extension portions have two series of diametrically opposite aligned bolt-receiving openings therethrough, and at least some of the bolts extending diametrically across said bodies extend through four openings of said bodies at their overlapping portions, that is, two diametrically opposite openings through each guard body.

43. The assembly of claim 30 wherein said bolts that hold the guard assembly together extend across and between said overlapping portions.

44. The assembly of claim 43, having also some bolts that extend across and between said arcuate portions.

45. The assembly of claim 30 wherein said bolts that hold the guard assembly together extend across and between said arcuate portions.

46. The assembly of claim 30 wherein said plurality of bolts includes at least three bolts on one side of said guy wire and a fourth bolt on the opposite side of said guy wire, facing the one of said three bolts that lies between the other two and cooperating with it to hold said guy wire in tension between them.

47. A guarded guy-wire and ground anchor rod assembly comprising a ground anchor rod secured permanently at a base and extending upwardly at an angle, a plurality of guy wires each secured at its lower end to said rod and extending upwardly therefrom, and diverging from each other to provide an upper and lower guy wire, a pair of elongate generally tubular bodies for each guy wire, each having a 180° arcuate portion with a straight extension portion at each end, one being upper body and one a lower body, the upper body for the upper guy wire extending past the lower body for the upper guy wire at the lower extremity of said bodies and the lower body for the lower guy wire extending past the upper body for the lower guy wire at the lower extremity of said bodies, the bodies being assembled to enclose most of said ground anchor rod and a substantial portion of said guy wire, said bodies being aligned so that the overlapping extension portions of each body are diametrically opposite each other and overlap corresponding portions of the other body, the two arcuate portions also being diametrically opposite each other, a plurality of bolts, each extending diametrically across the generally circular structure formed by said overlapping bodies and through said bodies, each bolt having a head at one end outside the body assembly and a nut threaded on the other end outside said body assembly, to secure said pair of bodies together and to fully enclose the guy-wire and ground anchor for the height of said guard bodies, one lowest said bolt near the lower end of the two longer bodies connecting said rod to said ground anchor rod, and also connecting the upper body of said upper guy wire to the lower body of said lower guy wire, other said bolts being spaced therefrom at intervals up to a locus near the upper end of said body, at least one said guard body of each pair having at least one pair of circumferentially aligned fastener openings through its said arcuate portion, and a fastener combination for each pair of fastener openings, comprising a bolt-like member with a head on its outer end and extending inwardly through one said fastener opening to a nut at its inner end and a locking washer member having a flat portion with an oval opening therethrough and having its main axis oriented longitudinally of said flat portion, said bolt-like member passing through said oval opening between said head and said nut, and an end tab of said locking washer member extending at an angle from one end of said flat portion to a hooked outer end that extends through the other said fastener opening and engages the outer wall of the adjacent guard body, each said guy wire being clamped against said one guard body by said fastener combination.

48. The assembly of claim 47 having an intermediate third guy wire enclosed within a third pair of said guard bodies, said third pair terminating above said lower end of said upper guard body of said upper guy wire and said lower guard body of said lower guy wire.

49. The assembly of claim 48 wherein one of said third pair of guard members extends down further than the other.

50. The assembly of claim 49 wherein the longer of said third pair of guard members is its upper guard member and is pinned to the lower guard member of said lower guy wire at a point spaced away from said lowest bolt.

51. The assembly of claim 50 wherein the longer of said third pair of guard members is its lowest guard member and is pinned to the upper guard member of said upper guy wire at a point spaced away from said lowest bolt.

52. A fastener combination for use for clamping a wire or wire-like member against an inner wall of a generally arcuate body having at least one pair of peripherally aligned fastener openings, said wire extending longitudinally within said body, comprising a bolt-like member with a head on its outer end for extending inwardly through one said fastener opening, a nut threaded on its other end, and a locking washer member having a flat portion with an opening therethrough, said bolt-like member passing through said washer opening between said head and said nut, and an end tab of said locking washer member extending at an angle thereto to a hooked outer end for extending through the other said fastener opening and engaging the outer wall of the adjacent body, so that a said wire can be clamped between said flat portion and the inner wall of said body and is adopted to be retained there between said bolt-like member and said hooked outer end, both of which are adapted to extend through said body via said pair of fastener openings and locked to said outer wall to prevent escape of said wire or wire like member.

53. The fastener combination of claim 52 wherein the opening through said flat portion is oval with its main axis oriented longitudinally of said flat portion.

* * * * *

UNITED STATES PATENT AND TRADEMARK OFFICE

CERTIFICATE OF CORRECTION

PATENT NO. : 4,638,611

DATED : January 27, 1987

INVENTOR(S) : Charles R. Vaughn

It is certified that error appears in the above-identified patent and that said Letters Patent are hereby corrected as shown below:

First page, right-hand column, lines 26-27 of Abstract, "longitudinal" should read --longitudinally--.

Column 3, line 25, "pump" should read --bump--.

Column 16, line 26, which is line 1 of claim 51, "claim 50" should read --claim 49--.

Column 16, line 27, which is line 2 of claim 51, "lowest" should read --lower--.

Signed and Sealed this

Twenty-second Day of September, 1987

*Attest:*

DONALD J. QUIGG

*Attesting Officer* *Commissioner of Patents and Trademarks*